US007708369B2

(12) United States Patent
Hanaoka et al.

(10) Patent No.: US 7,708,369 B2
(45) Date of Patent: May 4, 2010

(54) INK TANK AND INK JET PRINTER INCORPORATING THE SAME

(75) Inventors: Yukihiro Hanaoka, Nagano (JP); Koji Yamada, Nagano (JP); Hiroyuki Nakayama, Nagano (JP); Manabu Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 178 days.

(21) Appl. No.: 11/341,538

(22) Filed: Jan. 30, 2006

(65) Prior Publication Data

US 2006/0125891 A1 Jun. 15, 2006

Related U.S. Application Data

(63) Continuation of application No. 10/635,915, filed on Aug. 7, 2003, now Pat. No. 7,021,736.

(30) Foreign Application Priority Data

Aug. 9, 2002 (JP) ..... 2002-233885

(51) Int. Cl.
*B41J 29/393* (2006.01)

(52) U.S. Cl. ..... 347/19; 347/86

(58) Field of Classification Search ..... 347/19, 347/84–86

See application file for complete search history.

(56) References Cited

U.S. PATENT DOCUMENTS 5,079,570 A 1/1992 Mohr et al.
5,278,426 A * 1/1994 Barbier ..... 250/577
5,616,929 A 4/1997 Hara
6,361,136 B1 3/2002 Watanabe et al.
6,454,400 B1 9/2002 Morita et al.
6,457,793 B1 * 10/2002 Su ..... 347/7
6,616,255 B2 * 9/2003 Murakami et al. ..... 347/7
6,705,715 B2 3/2004 Morita et al.
6,736,496 B2 5/2004 Hanaoka et al.
7,021,736 B2 * 4/2006 Hanaoka et al. ..... 347/19
2002/0171720 A1 11/2002 Hanaoka et al.
2004/0104949 A1 6/2004 Morita et al.

FOREIGN PATENT DOCUMENTS

EP 0 624 476 11/1994
EP 0 706 888 4/1996
JP 6-115089 4/1994
JP 6-328717 11/1994
JP 10-323993 12/1998
JP 11-334097 12/1999
JP 2000-71471 3/2000
JP 2000-318179 11/2000
JP 2001-63085 3/2001
JP 2002-326369 11/2002

* cited by examiner

*Primary Examiner*—Lamson D Nguyen
(74) *Attorney, Agent, or Firm*—Nixon & Vanderhye P.C.

(57) ABSTRACT

An ink chamber is formed with a vent port allowing atmospheric air to enter therein and an ink outlet from which ink is taken out. An optical member has an ink contact face capable of contacting with ink contained in the ink chamber. The ink contact face includes a detection face at which a remaining amount of ink in the ink chamber is optically detected in accordance with an amount of air entered into the ink chamber via the vent port. A first ink absorbing member is disposed in the vicinity of the ink contact face, and capable of absorbing the ink in the ink chamber.

7 Claims, 13 Drawing Sheets

INK TANK AND INK JET PRINTER INCORPORATING THE SAME

CROSS-REFERENCES TO RELATED APPLICATIONS

This application is a continuation of U.S. patent application Ser. No. 10/635,915, filed Aug. 7, 2003 now U.S. Pat. No. 7,021,736, which claims priority of Japanese Patent Application No. 2002-233885, filed Aug. 9, 2002. The entire contents of these applications are incorporated herein by reference.

BACKGROUND OF THE INVENTION

The present invention relates to an ink tank for containing ink and an ink jet printer incorporating the ink tank as an ink supply source, and more particularly to an ink tank having a mechanism capable of precisely detecting a condition where ink has run out (an ink end).

Among those for use in ink jet printers is a known ink tank of such a type having the ink absorbed by and held in an ink absorbent material such as foam and felt. A foam-type ink tank, for example, has a container in which foam that has absorbed and held ink is contained therein, an ink outlet communicating with the foam container, and an vent port communicating with the atmosphere for opening the foam container into the atmosphere. When ink is sucked from the ink outlet by the ejection pressure of an ink jet head, air corresponding to the sucked amount of ink is caused to flow into the foam container.

In the case of such a foam-type ink tank, the calculation of the consumed amount of ink is carried out according to the number of ink dots ejected from the ink jet head, the sucked amount of ink through an ink pump for sucking ink from the ink jet head and so forth, so that the detection of the presence or absence of ink therein is made according to the calculated results.

Incidentally, a condition where ink in the ink tank has almost run out is generally called a "real end" and a condition where a residual amount of ink in the ink tank has decreased to an amount smaller than the predetermined amount is called a "near end." However, an "ink end" used in this specification includes both the conditions above unless otherwise specified.

However, the method of detecting the ink end by calculating the consumed amount of ink and the like has the following problem. Since the ejected amount of ink from the ink jet head and the sucked amount of ink through the ink pump undergo wide variation, the consumed amount of ink that has been calculated according to the above amounts also shows a variation far greater than that of the actually consumed amount of ink. Therefore, a great margin needs setting in order to settle the ink end. Consequently, a greater amount of ink may be left at a point of time that the ink end is detected, whereby ink may often be wasted.

Therefore, with a back surfaces of a reflective face of a prism as an interface with respect to ink, it is conceivable to directly detect the ink end by an optical detection system utilizing optical characteristics in that the reflective face of the prism is restored as its was when ink is used. For example, Japanese Patent Publication No. 10-323993A and U.S. Pat. No. 5,616,929 disclose such a detection system.

In the case of a foam-type ink tank, however, ink absorbed by and held in the ink absorbent material (foam) is always kept in contact with the reflective face of the prism even though the back surfaces of the reflective face of the prism is so arranged as to be exposed in the foam container, the reflective characteristics of the prism remain unchanged even when ink has run out. Consequently, the above disclosed detection system is not directly applicable to the foam-type ink tank.

It is also conceivable to adopt an arrangement wherein air is introduced into a sub ink chamber under pressure control with ink in the main ink chamber consumed to a certain degree by forming such a sub ink chamber that is small in capacity and capable of storing ink between the main ink chamber (foam container) and an ink outlet, and by disposing the reflective face of the prism in the sub ink chamber to make the back surfaces of the reflective face an interface with respect to ink.

Accordingly, when the amount of ink left in the main ink chamber decreases, bubbles become introduced from the main ink chamber into the sub ink chamber every time ink is supplied from the ink outlet into the ink jet head. When ink in the main ink chamber is completely used, the residual amount of ink in the ink tank comes to be substantially equal to only the amount of ink left in the sub ink chamber. As the residual amount of ink in the sub ink chamber decreases in amount further, the back surfaces of the reflective face of the prism as the interface with respect to ink is exposed from the liquid level of ink and the reflective condition of the reflective face changes. In other words, the reflective face kept from serving as a reflective face while the back surfaces thereof is covered with ink gradually recovers its reflective function with the liquid level of ink going down. Therefore, the condition where the residual amount of ink has decreased to the predetermined amount or smaller is detectable according to the amount of reflected light on the reflective face. Consequently, the ink end is detectable at a point of time the residual amount of ink has substantially completely used by making the capacity of the sub ink chamber sufficiently small.

However, the air introduced into the sub ink chamber causes bubbles to be generated in the sub ink chamber. In case there exists a condition where bubbles are adhered to or floating around the back surfaces of the reflective face of the prism, a condition where the reflective face of the prism is covered with the ink held among bubbles is maintained even when the liquid level of ink becomes lower than the reflective face of the prism. Consequently, the reflective condition of the reflective face of the prism will not change even though the liquid level of ink lowers. As it takes much time until bubbles covering the reflective face of the prism fade out, there occurs nonconformity in that the ink end is not detected until then. Hence, the detection timing of the ink end is delayed and this causes a harmful effect such as dot missing because bubbles are sent to an ink jet head as a result of lost suction of ink.

SUMMARY OF THE INVENTION

It is therefore an object of the invention is to provide an ink tank capable of obviating a harmful influence caused by the fact that the reflective condition of a reflective face of a prism remains unchanged immediately after the liquid level of ink lowers because of bubbles in a sub ink chamber.

It is also an object of the invention is to provide an ink jet printer which makes it possible to immediately recognize a condition where an ink end is brought about by detecting the reflective condition of the reflective face of an ink tank.

In order to achieve the above object, according to the invention, there is provided an ink tank, comprising:

an ink chamber, formed with a vent port allowing atmospheric air to enter therein and an ink outlet from which ink is taken out;

an optical member, having an ink contact face capable of contacting with ink contained in the ink chamber, the ink contact face including a detection face at which a remaining amount of ink in the ink chamber is optically detected in accordance with an amount of air entered into the ink chamber via the vent port; and a first ink absorbing member, disposed in the vicinity of the ink contact face, and capable of absorbing the ink in the ink chamber.

In such a configuration, as ink is supplied from the ink outlet, air enters the ink chamber from the vent port so that the liquid level of ink lowers. The detection face of the optical member is gradually exposed from the liquid level of ink accordingly. As a result, the optical property of the detection face (e.g., reflectivity or transmissivity) changes.

More specifically, in the case where the reflectivity of the detection face changes, the detection face that has not served as a reflective face while the ink contact face is covered with ink gradually regains the reflective function as the liquid level of ink lowers. In the case where the transmissivity of the detection face changes, as transmission of ink that has been impossible while the detection face is covered with ink is restored, a condition where the residual amount of ink decreases to a predetermined amount or smaller comes to be detectable according to the amount of reflected light or transmitted light.

When the residual amount of ink becomes smaller, bubbles are often generated. The bubbles thus generated stick to the detection face or become afloat in the vicinity of the detection face. In a case that the detection face is covered with such bubbles, even though the liquid level of ink lowers, the optical property of the detection face remains unchanged, which may result in making the detection of the ink end impossible.

According to the invention, however, since the first ink absorbing member is disposed in a position adjacent to the ink contact face, the ink held in the bubbles generated in the detection face is sucked into the first ink absorbing member by the capillary force thereof. Therefore, bubbles are quickly extinguished so that the optical property of the detection face is immediately changed as the liquid level of ink in the ink chamber lowers, in order to ensure that the ink end is quickly detected.

Preferably, the ink chamber includes: a first chamber, formed with the vent port and containing a second ink absorbing member capable of holding ink therein; and a second chamber, disposed between the first chamber and the ink outlet and containing the first ink absorbing member and the optical member.

Since the optical member is disposed in the second chamber, the ink end is detectable at a point of time the residual amount of ink has substantially completely used by making the capacity of the second chamber sufficiently small. Moreover, air together with ink enters the second chamber from the first chamber as the residual amount of ink decreases, so that the influence of the bubbles generated in the second chamber can be removed by the first ink absorbing member.

Preferably, the first ink absorbing member is placed at an ink flow passage between the optical member and the ink outlet. In such a configuration, bubbles are efficiently extinguished because the ink held in the bubbles is sucked by the first ink absorbing member as the consumption of ink continues.

Preferably, the first ink absorbing member is placed away from the detection face. In such a configuration, bubbles sticking to the detection face can quickly be sucked and extinguished by the first ink absorbing member without interfering the optical detection.

Preferably, the ink tank further comprises: a first filter, partitioning the first chamber and the second chamber, the first filter comprised of a first porous material having a first porousness so as to allow ink and air bubbles to pass therethrough; and a second filter, partitioning the second chamber and the ink outlet, the second filter comprised of a second porous material having a second porousness finer than the first porousness so as to allow only ink to pass therethrough. Here, the first ink absorbing member has a third porousness coarser than the first porousness.

For example, the first ink absorbing member is comprised of at least one of a foam material and a felt material.

Preferably, the optical member is a prism provided with a pair of reflective faces serving as the detection face.

Preferably, the ink tank further comprises a partition member which partitions the second chamber into a bubble storage located in the vicinity of the first chamber and an ink reservoir located in the vicinity of the ink outlet, the partition member formed with an introduction port which introduces ink from the bubble storage to the ink reservoir. Here, the detection face of the optical member is placed in the ink reservoir.

In such a configuration, ink flowing from the first chamber into the bubble storage is passed through the introduction hole of the partition member before being introduced into the ink reservoir. When ink in the first chamber is completely used, air enters bubble storage of the second chamber from the first chamber communicating with the atmosphere, thus causing bubbles to be formed. Consequently, the bubbles are gradually gathered in the bubble storage, which is then filled with bubbles. As the amount of bubbles increases, the residual amount of ink in the second chamber gradually decreases and the liquid level of ink gradually lowers from the inside height position of the bubble storage.

When the bubble storage is filled with bubbles and after the liquid level of ink lowers up to the inside height position of the second chamber, ink for use in newly generating bubbles is nonexistent because the bubble storage is filled with bubbles when air enters from the first chamber. Consequently, bubbles filling up the bubble storage are crushed into large bubbles little by little as the entrance of air continues and bubbles in the bubble storage disappear by degrees, whereas a layer containing only air is gradually formed from the upper end side of the bubble storage.

In other words, the bubble storage is separated by the partition member from the ink reservoir but communicates with only the introduction hole. Consequently, ink necessary for forming bubbles can be blocked by the partition member from being supplied to the bubble storage. Thus the partition member serves as what separates the liquid level of ink from bubbles and when the liquid level of ink lowers, the separation of bubbles in the bubble storage from the liquid level of ink is facilitated.

Therefore, the bubbles gathered in the bubble storage are extinguished little by little in the bubble storage because ink for use in forming bubbles is stopped from being supplied from the ink reservoir, and the formation of the layer containing only air in the upper end portion is started. This layer containing only air gradually spreads toward the ink reservoir as the liquid level of ink in the second chamber lowers, that is, as the entrance of air from the first chamber continues. As bubbles in the bubble storage are then extinguished and replaced with air, the liquid level of ink in the ink reservoir lowers with no bubbles formed.

Hence, bubbles are restrained from entering the ink reservoir and covering the detection face. Moreover, according to the invention, since the first ink absorbing member is disposed in a position adjacent to the ink contact face disposed in the ink reservoir, the ink held in the bubbles floating in the vicinity of the detection face are sucked by the capillary force of the first ink absorbing member, whereby the bubbles generated in the detection face are quickly extinguished. Accordingly, the optical property of the detection face changes at excellent response timing as the liquid level of ink lowers, so that the ink end can be detected precisely without delay.

Here, it is preferable that the detection face is placed in the vicinity of the introduction port. In such a configuration, detecting precision can be enhanced by utilizing the effect of forcing out bubbles sticking to the detection face with ink supplied from the introduction hole toward the first ink absorbing member.

It is also preferable that the introduction port is located at a corner portion defined by wall faces of either the partition member or the second chamber. In such a configuration, bubbles entering from the introduction hole are mainly concentrated on the corner portion by the surface tension and moved along the wall faces to the first ink absorbing member, so that floating bubbles can be decreased.

It is also preferable that the partition member is provided with pieces projecting into the ink reservoir to retain the first ink absorbing member therebetween.

It is also preferable that the partition member defines an ink flow passage extending from the introduction port to the first ink absorbing member via the detection face. In such a configuration the ink held in the bubbles generated on the detection face can efficiently be absorbed by the first ink absorbing member and the bubbles are also quickly extinguished.

According to the invention, there is also provided an ink jet printer, comprising:

an ink jet print head;

the above ink tank, which supplies ink to the ink jet print head via the ink outlet; and a detector, which optically detects the remaining amount of ink in the ink tank based on a condition of the detection face.

In such a configuration, the optical property of the detection face changes at excellent response timing as the liquid level of ink lowers, whereby the ink end of the ink tank is quickly detectable.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will now be described by reference to the accompanying drawings. More specifically, the following refers to embodiments of the invention applied to an ink tank detachably fitted to a tank mounting portion of an ink jet printer. However, the invention is similarly applicable to an ink tank prearranged in an ink jet printer.

Figure 13:
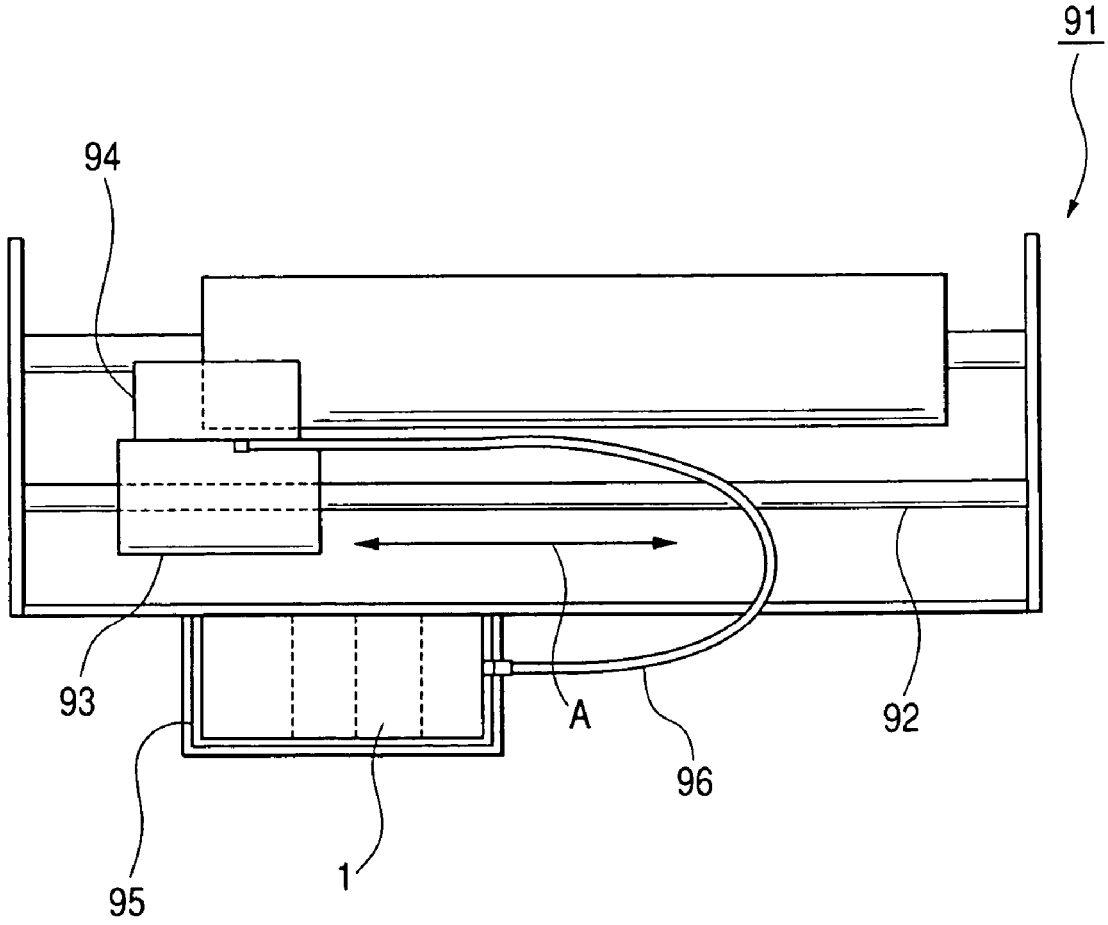
FIG. 13 is a schematic illustration showing an essential part of an ink jet printer.

As shown in FIG. 13, an ink jet printer 91 according to a first embodiment of the invention is of a serial type wherein an ink jet head 94 is loaded on a carriage 93 reciprocating along a guide shaft 92 in the direction of arrows A. Ink is supplied from an ink tank 1 mounted in a tank mounting portion 95 via a flexible tube 96 to the ink jet head 94.

The ink tank 1 for use according to this embodiment of the invention is detachably mounted in the tank mounting portion 95 formed in the ink jet printer 91. As shown in FIGS. 1A, 1B, 2, and 3, the ink tank 1 has a container body 2 in the form of a rectangular parallelepiped with its upper side opened and a container cover 4 used to block up an upper-side opening 3. A main ink chamber 5 is formed inside and a rectangular parallelepiped foam 6 is contained in the main ink chamber 5, ink being absorbed by and held in the foam 6.

An ink outlet 7 is formed in the base of the container body 2 and disc-shaped rubber packing 8 is mounted in the ink outlet 7 and a through-hole 8*a* bored in the center of the rubber packing 8 serves as an ink outlet hole. In the rear portion of the rubber packing 8 in the ink outlet 7, a valve 9 capable of closing the ink outlet hole 8*a* is arranged and is usually pressed by a coil spring 10 against the rubber packing 8 so as to block up the ink outlet hole 8*a*.

The main ink chamber 5 communicates with the ink outlet hole 8*a* via a sub ink chamber 20 partitioned by a first filter 11 and a second filter 12. The main ink chamber 5 is also opened to a vent port 13 communicating with the atmosphere formed in the container cover 4. When the ink absorbed by and held in the foam 6 mounted in the main ink chamber 5 is sucked via the ink outlet hole 8*a*, air corresponding in quantity to the ink thus sucked is introduced into the main ink chamber 5 from the ports 13 communicating with the atmosphere.

The inside of the sub ink chamber 20, which will be described in detail with reference to FIGS. 4 to 7, is partitioned by a partition member 30 into a bubble storage 21 on the main ink chamber side and an ink reservoir 22 on the ink outlet hole side, the storage 21 and the reservoir 22 communicating with each other via an introduction hole 33 formed in the partition member 30. A bubble-extinguishing porous member 40 is incorporated in the ink reservoir 22.

The vent port 13 communicating with the atmosphere in the container cover 4 is linked with a winding groove 13*a* engraved in the surface of the container cover and the end 13*b* of the groove 13*a* is extended up to the vicinity of the edge end of the container cover 4. When the ink tank 1 is shipped, a seal 14 is adhered to the portion where the vent port 13 and the groove 13*a* of the container cover 4 are formed. On the other hand, when the ink tank 1 is used, part 14*b* of the seal 14 is torn off along cutting lines 14*a* of the seal 14 whereby to expose the end 13*b* of the groove 13*a*, thus setting the ports 13 open to the atmosphere.

Moreover, a seal 15 is also adhered to the portion of the ink outlet hole 8*a* in the bottom of the container so that an ink supply needle (not shown) attached to the tank mounting portion 95 is made to break the seal 15 before being thrust into the ink outlet hole 8*a* when the ink tank 1 is mounted in the tank mounting portion 95 of the ink jet printer 91.

Figure 1A:
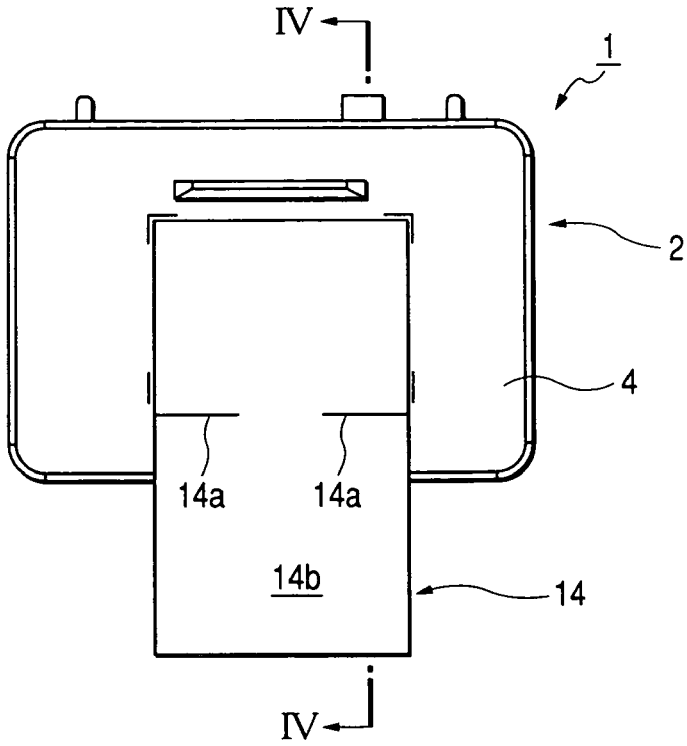
FIG. 1A is a plan view of a foam-type ink tank according to a first embodiment of the invention.
Figure 1B:
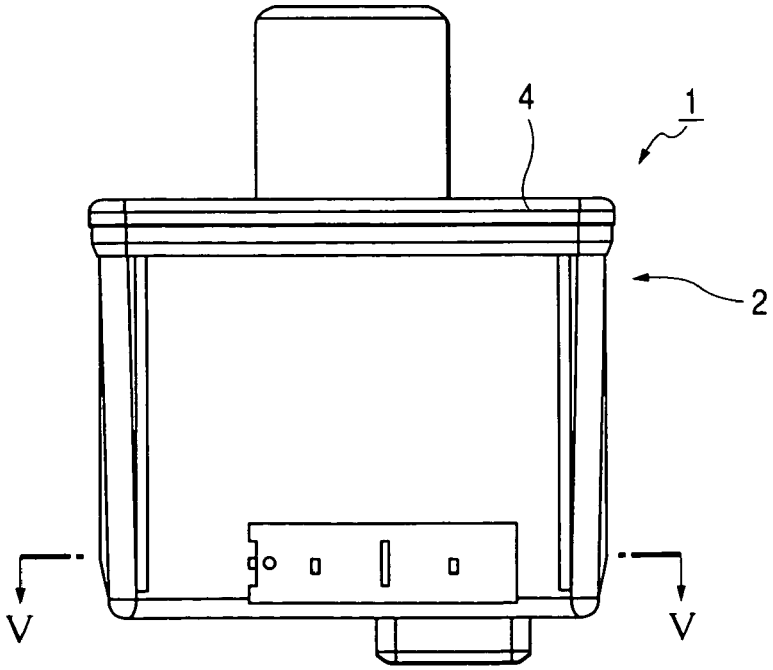
FIG. 1B is a front view of the ink tank of the first embodiment.
Figure 2:
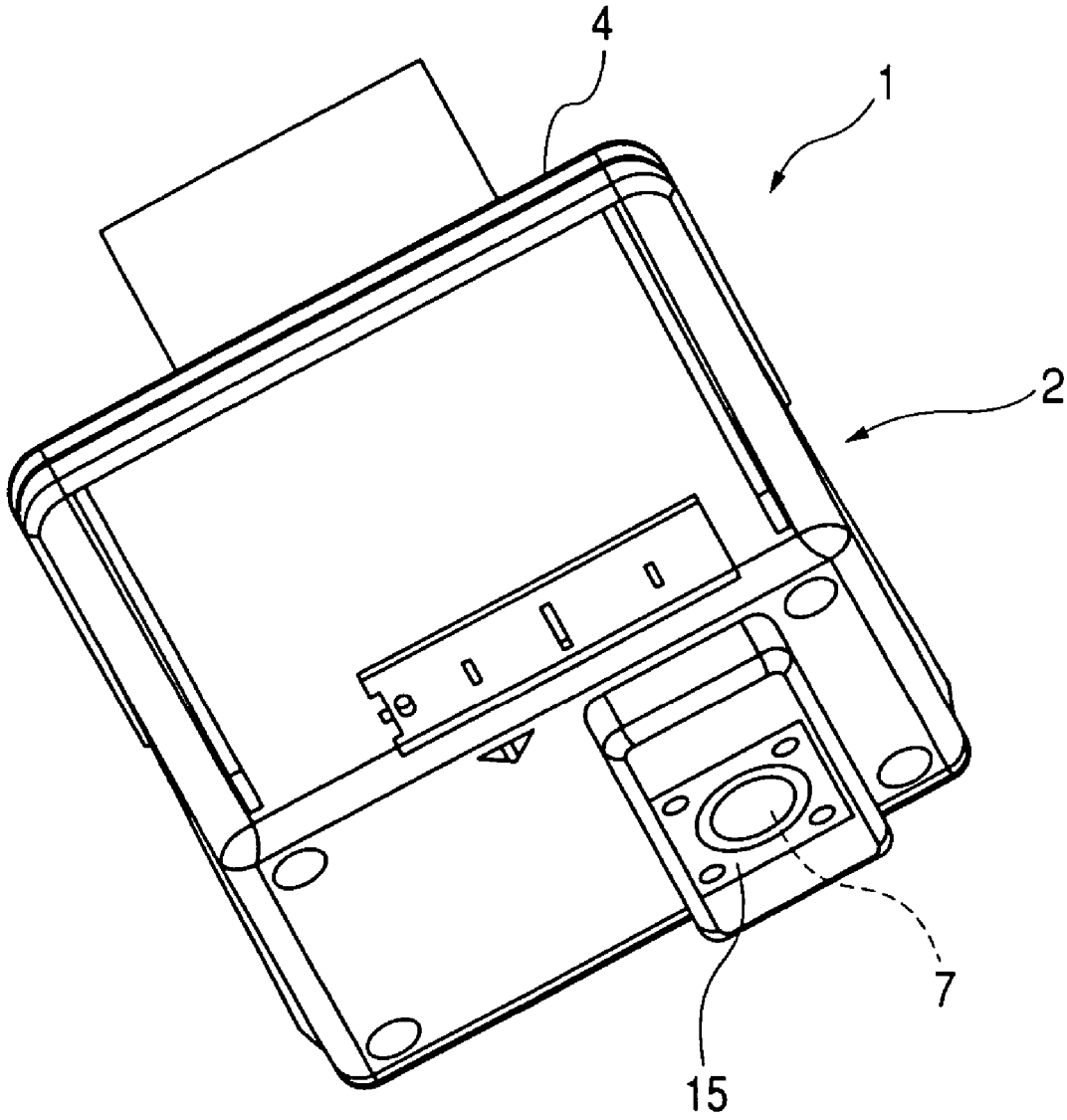
FIG. 2 is a bottom perspective view of the ink tank of the first embodiment.
Figure 3:
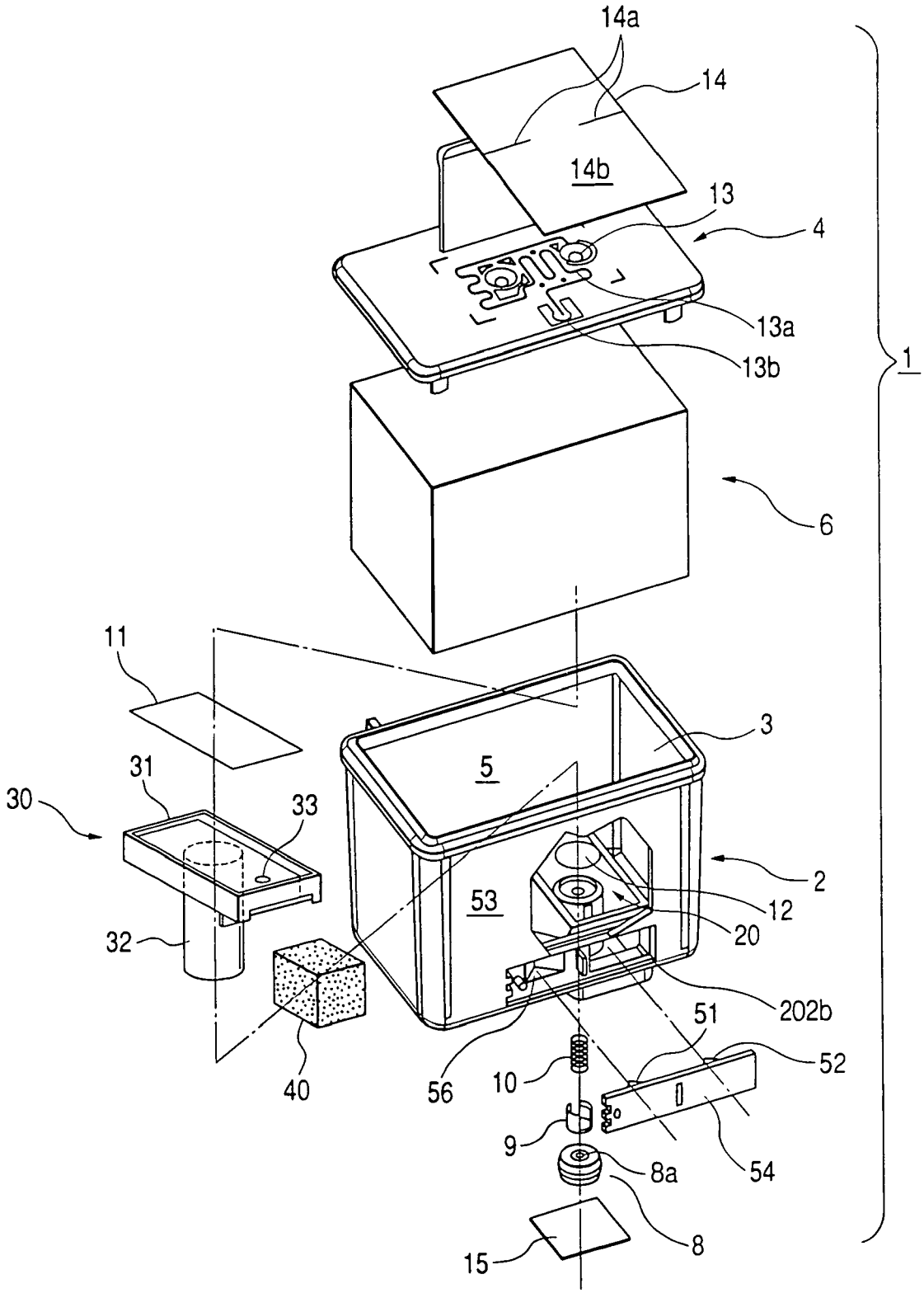
FIG. 3 is an exploded perspective view of the ink tank of the first embodiment.

As shown in FIG. 3, the partition member 30 is provided with a partition panel 31 for partitioning the sub ink chamber 20 and a cylindrical frame 32 perpendicularly projecting from the center of the ink reservoir side of the partition panel 31. Further, the introduction hole 33 for introducing ink from the bubble storage 21 into the ink reservoir 22 is formed in the one end side portion of the partition panel 31.

The ink tank 1 is provided with a detected portion having a right prism 51 for use in optically detecting whether the ink tank 1 is mounted in the tank mounting portion 95 of the ink jet printer 91 and a right prism 52 for use in optically detecting the ink end of the ink tank 1. The back surfaces of the reflective face of the right prism 52 is exposed in the ink reservoir 22 of the sub ink chamber 20 to serve as an interface with respect to ink.

Figure 4:
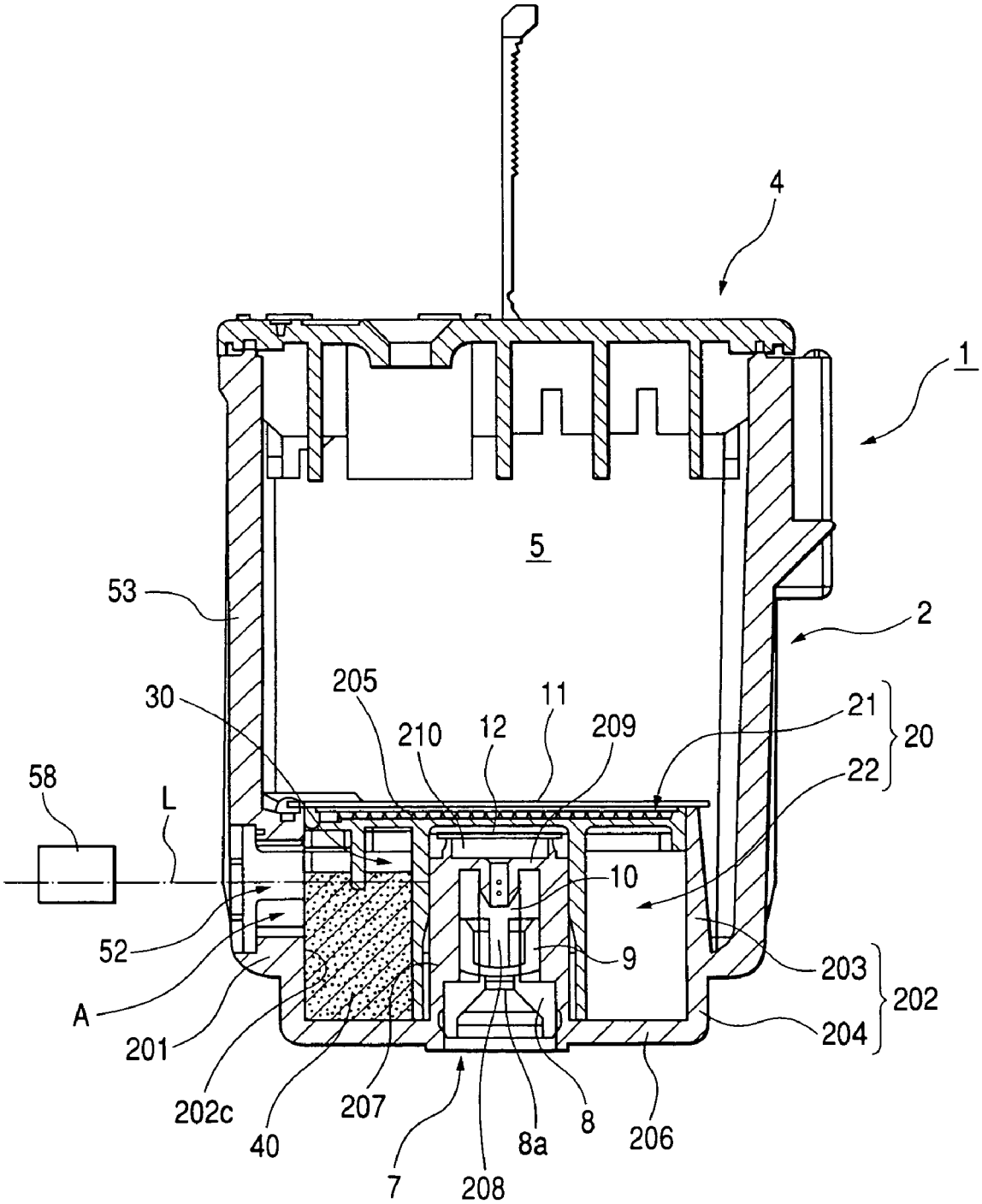
FIG. 4 is a sectional view of the ink tank of the first embodiment, taken on the line IV-IV of FIG. 1A.

More specifically, as shown in FIG. 4, a frame 202 rectangular in cross section is passed through the bottom plate 201 of the container body 2 and extended vertically and perpendicularly. A rectangular opening of an upper frame portion 203 perpendicularly uprighted in the main ink chamber 5 forms a communication port 205 on the main ink chamber side. The first rectangular filter 11 is fitted to the communication port 205.

The lower end of a lower frame portion 204 projecting perpendicularly downward from the bottom plate 201 is blocked up by a bottom plate 206 continued from the bottom plate 201, and the ink outlet 7 is formed in the center of the bottom plate 206. The ink outlet 7 has a cylindrical projected portion 207 projecting perpendicularly upward (within the ink reservoir 22) from the center of the bottom plate 206 and the central hole of the projected portion 207 forms an ink passage 208 communicating with the ink outlet hole 8*a*. The rubber packing 8, the valve 9 and the coil spring 10 are mounted in the ink passage 208. A spring holder 209 for the coil spring 10 is formed integrally with the inner peripheral face of the projected portion 207. The upper-side opening of the projected portion 207 forms a circular communication port 210 on the outlet hole side and the second filter 12 is fitted to the communication port 210.

The first filter 11 is made of porous material that passes ink and is simultaneously capable of causing bubbles to pass therethrough by ink sucking force acting on the ink outlet hole 8*a*. In other words, the filter 11 is made of porous material whose pore size corresponds to capillary gravitation by which the meniscus is destroyed because of the ink sucking force. In this case, the first filter 11 is formed of unwoven fabric, a mesh filter or the like.

On the other hand, the second filter 12 is made of porous material whose pore size is smaller than that of the first filter 11, so that the filter 12 allows no bubbles, but only ink to pass therethrough when the ink sucking force acts on the ink outlet hole except that an ink pump is being operated. The pore size of the second filter 12 should be large enough to capture alien substances mingling in ink. The second filter 12 may also be formed of unwoven fabric, a mesh filter or the like.

In this case, the "ink sucking force" means force acting on ink outlet hole 8*a* by the ink ejection pressure of the ink jet head 94 or the sucking force of the ink pump.

Further, the right prisms 51 and 52 will now be described with reference to mainly FIGS. 3 through 5. An elongated rectangular plate 54 is fixedly welded to the lower end portion of a side plate portion 53 of the container body 2. The right prisms 51 and 52 are formed integrally with the inner side of the rectangular plate 54 with a predetermined space held therebetween. The right prism 51 has a pair of reflective faces 51*a* and 51*b* crossing at right angles and the right prism 52 has a pair of reflective face 52*a* and 52*b* crossing at right angles.

The right prism 51 faces the side plate portion 53 via an air layer 55 having a predetermined gap. In other words, a recessed portion 56 corresponding in configuration to the right prism 51 is formed in the side plate portion 53, whereby the reflective faces 51*a* and 51*b* face the side plate portion 53 via the air layer 55 having the predetermined gap.

On the other hand, the right prism 52 for detecting the ink end is directly exposed in the inside of the ink reservoir 22 from an opening 202*b* opened in the frame 202 defining the ink reservoir 22, and the back surfaces of each of the reflective faces 52*a* and 52*b* serves as an interface with respect to ink.

Figure 5:
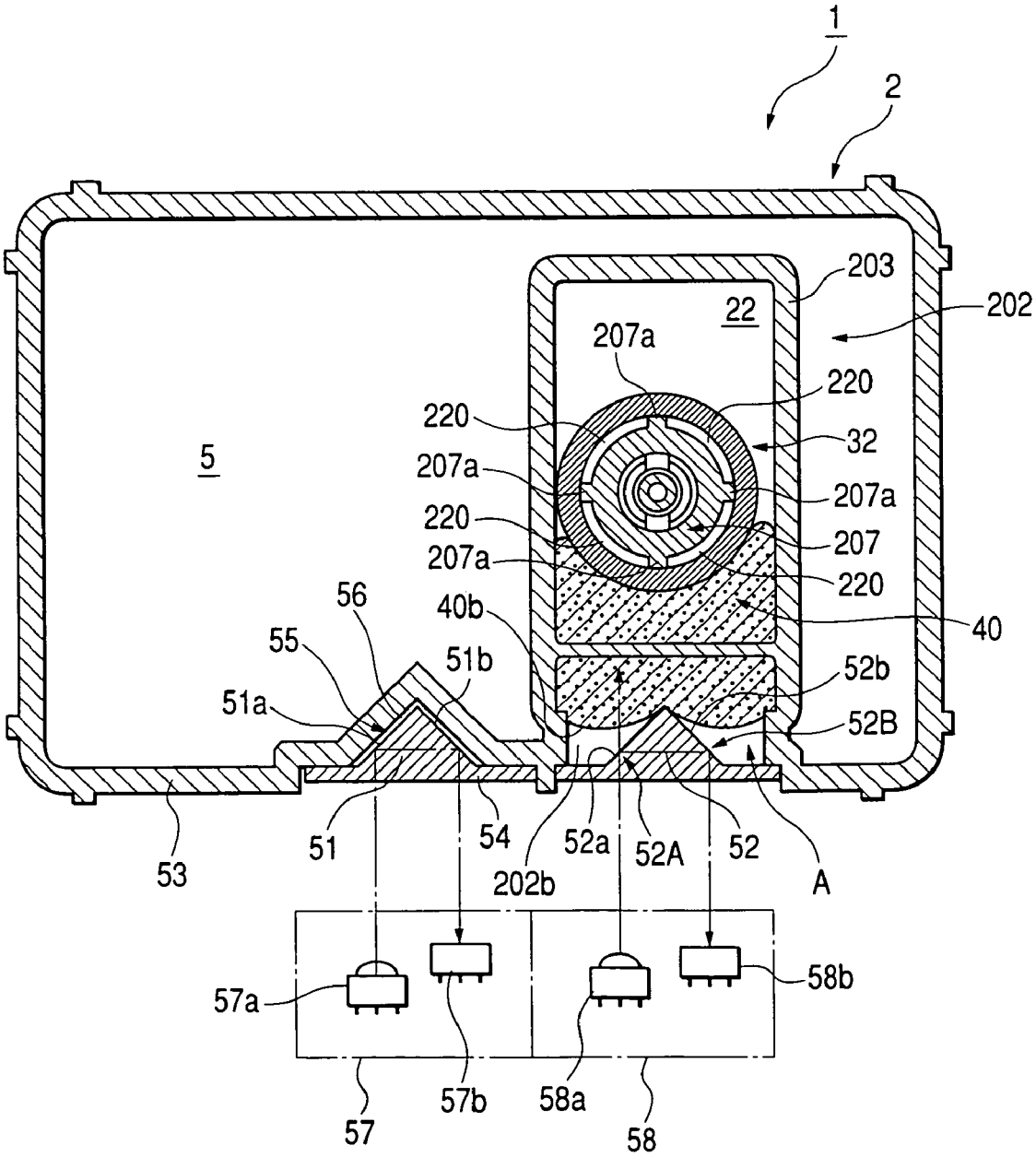
FIG. 5 is a sectional view of the ink tank of the first embodiment, taken on the line V-V of FIG. 1B.

As shown in FIGS. 4 and 5, reflection type optical sensors 57 and 58 are installed on the side of the ink jet printer 91 provided with the ink tank 1. The optical sensors 57 and 58 are respectively provided with light emitting elements 57*a* and 58*a* and light receiving elements 57*b* and 58*b*. The position of the optical sensor 57 is set so that the optical sensor 57 makes the light emitted from the light emitting element 57*a* incident at an angle of 45 degrees with the reflective face 51*a* and also makes the light receiving element 57*b* receive the return light reflected from the reflective face 51*a* and the reflective face 51*b*. Similarly, the position of the optical sensor 58 is set so that the optical sensor 58 makes the light emitted from the light emitting element 58*a* incident at an angle of 45 degrees with the reflective face 52*a* and also makes the light receiving element 58*b* receive the return light reflected from the reflective face 52*a* and the reflective face 52*b*.

Figure 6A:
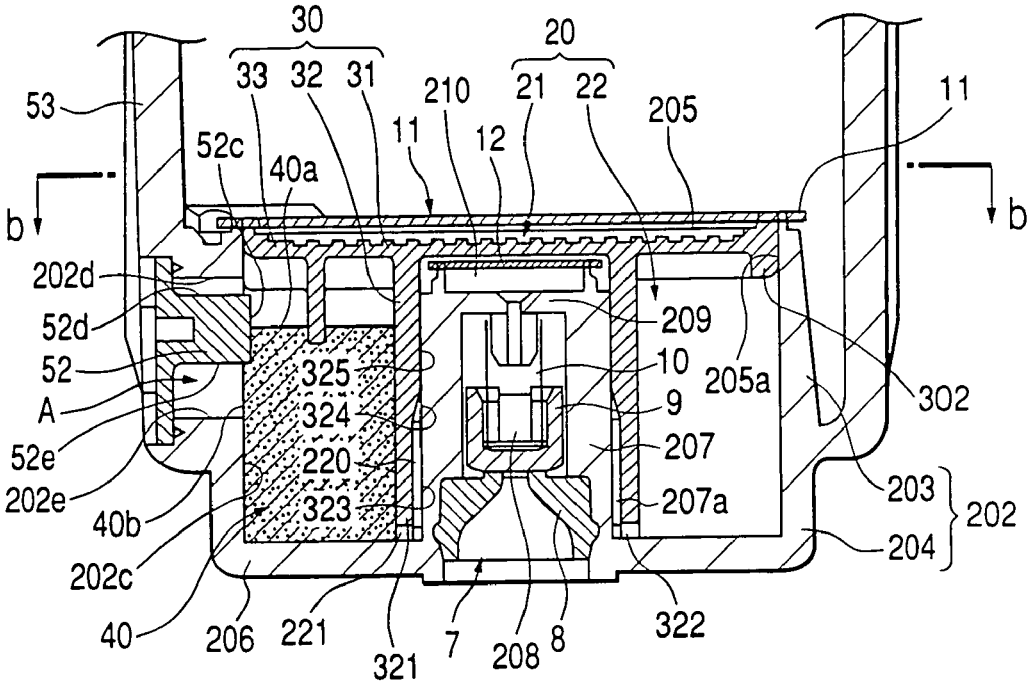
FIG. 6A is an enlarged sectional view of a sub ink chamber in the ink tank of the first embodiment.
Figure 6B:
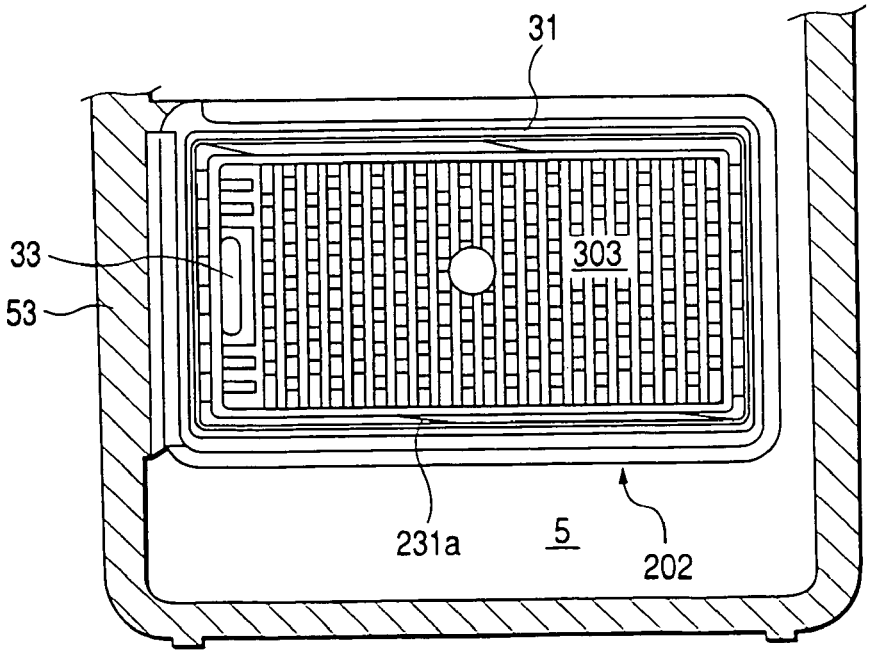
FIG. 6B is a section view of the ink tank of the first embodiment, taken along the line b-b in FIG. 6A.
Figure 7:
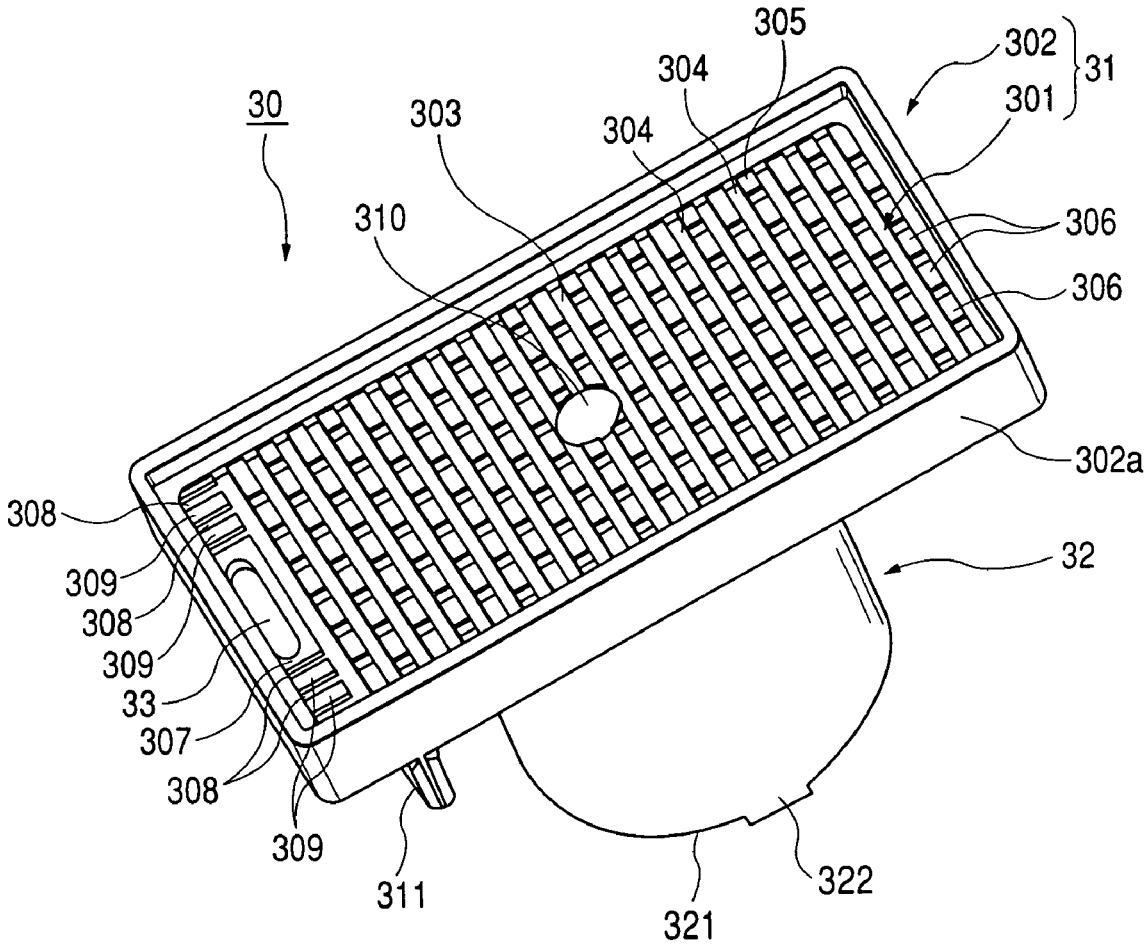
FIG. 7 is a perspective view of a partition member in the ink tank of the first embodiment.

As shown in FIGS. 6A and 7, an outer face 302*a* of a peripheral frame portion 302 is connected liquid-tightly to an inner peripheral side 205*a* of the communication port 205 in the rectangular frame 202 forming the sub ink chamber 20.

The surface of a panel body 301 (the surface on the side of the bubble storage 21) is formed as an uneven surface 303. The uneven surface 303 serves as a bubble trap for capturing bubbles formed by the air introduced from the main ink chamber 5 via the first filter 11 into the bubble storage 21 so as to prevent the bubbles from flowing toward the introduction hole 33.

The uneven surface 303 is so constituted that recessed portions 304 and protruded portions 305, having a fixed width and extending in the direction of the short side of the panel body 301, are formed alternately at predetermined intervals in the direction of the long side of the panel body 301. On the surface of each protruded portion 305, protrusions 306 having a predetermined length are formed discretely at predetermined intervals. When seen from along the direction of the long side of the panel body 301, the protrusions 306 discretely formed on the surface of each protruded portion 304 are alternately arranged. With the recessed portion 304 as a reference, each protruded portion 305 is 0.1 mm in height, for example, and the protrusions 306 formed on the surface of the protruded portion 305 is 0.2 mm in height, for example. The recessed portion 304 and the protruded portion 305 are 0.5 mm in width, for example.

The elliptic introduction hole 33 that is longer in the direction of the short side of the panel body 301 is formed in the central portion of the end portion on the side where the right prism 52 is disposed in the long side direction of the panel body 301. The perimeter of the introduction hole 33 is surrounded with a protruded frame portion 307 equal in height to the protrusions 306. Moreover, recessed portions 308 and protruded portions 309 extending in the long side direction of the panel body 301 are alternately formed at predetermined intervals in the direction of the short side of the panel body 301 at regions between the protruded frame portion 307 and the long-side edges of the panel body 301. The protruded portion 309 is equal in height to the protrusion 305.

A circular recessed portion 310 is formed in the center of the panel body 301. The partition member 30 is an injection-molded part made of resin material and this circular recessed portion 310 is a gate mark. Further, a drop wall 311 projecting downward further than the central position in the vertical direction of the right prism 52 is formed on a lower face (surface on the side of the ink reservoir 22) of the panel body 301. The drop wall 311 is formed over the whole width in the short side direction of the panel body 301.

The cylindrical frame 32 perpendicularly extended from the center of the undersurface of the panel body 301 is used to suck up ink accumulated on the bottom of the ink reservoir 22 up to the communication port 210 fitted with the second filter 12 positioned upward.

As shown in FIGS. 6A through 7, a plurality of projections 322 formed at intervals of predetermined angles are perpendicularly projected from a circular edge face 321 of the lower end opening of the cylindrical frame 32. In this embodiment, there are formed four projections 322 of the same height at intervals of 90 degrees. The inner peripheral face of the cylindrical frame 32 is provided with a lower part 323, a tapered part 324 that is continuous to the lower part 323 and slightly protruded inward, and an upper part 325 that is continuous to the tapered part 324.

The partition member 30 provided with the cylindrical frame 32 is mounted with capping applied from the upper side to the cylindrical projected portion 207. Ribs 207*a* projecting outside at intervals of predetermined angles are formed in the lower-side portion of the outer peripheral face of the projected portion 207. Four ribs 207*a* are formed at intervals of 90 degrees and the projected amount of each rib 207*a* is set so that these ribs 207 are just fitted in the outer peripheral face 323 on the lower end side of the cylindrical frame 32.

When the cylindrical frame 32 of the partition member 30 is fitted to the projected portion 207 with capping, four gaps 220 that are arcuate in cross section and used for sucking up ink are formed by the four ribs 207*a* between the inner peripheral face of the cylindrical frame 32 and the outer peripheral face of the projected portion 207. Consequently, there is formed an ink sucking passage led from a gap 221 to the second filter 12 positioned upward via the gaps 220 formed between the projected portions 322 at the lower end of the cylindrical frame 32. In so doing, the amount of ink left in the ink reservoir 22 decreases and even when the liquid level becomes lower than the second filter 12, the ink left in the ink reservoir 22 is sucked up to the position of the second filter 12 and can be supplied from the ink passage 208 to the ink outlet hole 8*a*.

The bubble-extinguishing porous member 40 disposed in the ink reservoir 22 of the sub ink chamber 20 will be described by reference to FIGS. 3 through 6B. The rectangular parallelepiped porous member 40 is made of flexible material such as felt and foam and disposed beneath the introduction hole 33 and in a position adjacent to the right prism 52. In this embodiment, the porous member 40 is arranged in such a condition as to be kept in contact with a corner portion 52*c* on the back surfaces of the reflective faces 52*a* and 52*b* of the right prism 52.

In other words, the porous member 40 is stuffed in between an inner side face 202*c* of the frame 202 fitted with the right prism 52 and the cylindrical frame 32 of the partition member 30. The porous member 40 is retracted with respect to the reflective faces 52*a* and 52*b* so that its upper edge face 40*a* is positioned in the middle of the height of the reflective faces 52*a* and 52*b*.

As shown in FIG. 5, a side 40*b* facing the right prism 52 of the porous member 40 is in a depressed condition as its central portion is brought into contact with the corner portion 52*c*. Any side portion other than that central portion is separated from the reflective faces 52*a* and 52*b*, so that the porous member 40 is prevented from contacting reflective areas 52A and 52B in particular where the detection light is reflected therefrom. Further, the upper edge faces 52*d* and 52*e* of the right prism 52 are also separated from vertical edge faces 202*d* and 202*e* of an opening 202*b* formed in the frame 202. Consequently, a space A is formed between the reflective faces 52*a* and 52*b* and the porous member 40 so as to surround the reflective faces 52*a* and 52*b*.

In this case, the porous member 40 is capable of absorbing and holding ink, and is made of material with larger meshes than those of the first filter 11.

The detection of whether the ink tank 1 has been mounted in the tank mounting portion 95 of the ink jet printer 91 as well as the ink end of the ink tank 1 are made as follows.

When the ink tank 1 is mounted in the tank mounting portion 95 of the ink jet printer 91, the front end portion of the ink supply needle (not shown) disposed on the side of the ink jet printer 91 passes through the through-hole of the rubber packing 8 mounted in the ink outlet 7 of the ink tank 1 and pushes up the valve 9 positioned in the ink passage 208. Consequently, as the ink outlet hole 8*a* is left open, the ink absorbed by and held in the foam 6 in the main ink chamber 5 is caused to flow into the ink passage 208 via the first filter 11 and the sub ink chamber 20 and to pass along the ink supply needle inserted into the ink outlet hole 8*a*, whereby the ink can be supplied to the ink jet head 94 on the side of the ink jet printer 91. Since such an ink supply mechanism is known in the art, further description will be omitted.

When the ink tank 1 is thus installed, the right prism 51 formed on the side of the ink tank 1 is made to face the optical sensor 57 on the side of the ink jet printer 91. Therefore, the light emitted from the optical sensor 57 is reflected by the reflective faces 51*a* and 51*b* of the right prism 51 before being received by the optical sensor 57, whereby it is detected that the ink tank 1 has been installed.

When the ink jet printer 94 is driven to perform ink ejection, the ink sucking force acts on the ink outlet hole 8*a* due to the ink ejection pressure, so that ink is supplied to the ink jet printer 94. As the ink held in the foam 6 decreases after it is supplied, air is introduced into the main ink chamber 5 via the vent port 13. As the consumption of ink continues, the ink infiltrated into the foam 6 gradually decreases and then bubbles enter the foam 6 instead. When the residual amount of ink in the foam 6 decreases further, air from the main ink chamber 5 passes through the first filter 11, thus forming bubbles, which are introduced into the bubble storage 21 of the sub ink chamber 20. However, the second filter 12 used to separate the ink reservoir 22 of the sub ink chamber 20 from the ink outlet hole 8*a* passes no bubbles through. Therefore, the bubbles are gradually gathered in the small-capacity bubble storage 21 formed in the uppermost portion of the sub ink chamber 20.

When the residual amount of ink further decreases, the liquid level of ink left in the main ink chamber 5 and the sub ink chamber 20 gradually lowers and the pair of prism reflective faces 52*a* and 52*b* of the right prism 52 is gradually exposed from the liquid level of ink. Consequently, the pair of the reflective faces 52*a* and 52*b* start serving as reflective members. When the liquid level of ink in the sub ink chamber 20 becomes lower than a predetermined detection position (e.g., position L shown in FIG. 4), the amount of received light of the light receiving element 58*b* of the optical sensor 58 exceeds a threshold amount. The detection of the absence of ink (the ink end state) in the ink tank 1 is based on an increase in the amount of received light at the light receiving element 58*b*.

As the ink end is detected at a point of time the residual amount ink becomes very small by making the capacity of the sub ink chamber 20 sufficiently small, the ink end is detectable with the residual amount of ink being as small as possible, whereby ink is prevented from being wasted. In this case, the ink end detected by the reflective faces 52*a* and 52*b* of the prism is regarded as the near end, whereupon the following process is performed, whereby ink is prevented from being wasted more certainly. That is, the near end of ink is detected by the optical sensor 58 first and then an amount of ink to be used thereafter is calculated and the real end is decided when the value obtained reaches an amount equivalent to the capacity of the ink reservoir 22 of the sub ink chamber 20, so that ink is usable until the residual amount of ink is substantially used up.

In the case where bubbles generated in the sub ink chamber 20 are floating in the vicinity of the reflective faces 52*a* and 52*b* of the right prism 52, the reflective faces 52*a* and 52*b* of the prism come to be substantially covered with ink. Even though the liquid level of ink becomes lower than the reflective faces 52*a* and 52*b* of the prism in the condition above, the reflective faces 52*a* and 52*b* of the prism remain covered with ink and the reflective condition also remains unchanged, so that the ink end is impossible to detect.

In this embodiment of the invention, however, the bubble storage 21 is formed by the partition panel 31 in the upper-end portion of the sub ink chamber 20 and the liquid level of ink drops with the liquid level of ink separated from bubbles when the residual amount of ink becomes smaller than the predetermined amount. It is therefore possible to suppress the generated amount of bubbles that are introduced into the ink reservoir 22 and floating in the vicinity of the reflective faces 52*a* and 52*b* of the prism.

The ink introduced from the bubble storage 21 via the introduction hole 33 into the ink reservoir 22 flows along the reflective faces 52*a* and 52*b* of the right prism 52 before being absorbed by the porous member 40. The ink is then sucked from the bottom portion of the ink reservoir 22 along the gap between the cylindrical frame 32 and the projected portion 207, and led to the ink outlet hole 8*a* through the second filter 12.

The bubbles together with the ink introduced from the introduction hole 33 into the ink reservoir 22 are gathered in the upper-side portion of the upper edge face 40*a* of the porous member 40 and in the space A between the porous member 40 and the reflective faces 52*a* and 52*b* of the right prism 52. However, the ink held in the bubbles gathered in these sites is sucked into the porous member 40 because of the capillary action of the porous member 40.

More specifically, the ink absorbed by and held in the porous member 40 is taken out with the ink sucking operation accompanied after the liquid level of ink becomes lower than the upper edge face 40*a* of the porous member 40 as the residual amount of ink decreases. When ink is taken out of the porous member 40, the ink held in the upper-side portion of the upper edge face 40*a* and what is held in the bubbles in the portion on the back surfaces of the reflective faces 52*a* and 52*b* are sucked by the capillary force. Consequently, the bubbles are quickly extinguished. When the liquid level of ink lowers in the ink reservoir 22, the reflective condition of the reflective faces 52*a* and 52*b* changes at excellent response timing. The ink end is thus detectable precisely and promptly.

In the ink tank 1 according to this embodiment, the sub ink chamber 20 is partitioned by the partition member 30 into the bubble storage 21 and the ink reservoir 22, which communicate with each other via only the introduction hole 33. Accordingly, ink necessary for the formation of bubbles is blocked by the partition member 30 from being supplied from the bubble storage 21 to the ink reservoir 22 as much as possible. Therefore, the partition member 30 serves as a separator so that bubbles in the bubble storage 21 are readily separated from ink as the liquid level of ink lowers. Moreover, the bubbles generated in the ink reservoir 20 are quickly extinguished because of the suction of ink by the capillary force of the porous member 40 disposed in the ink reservoir 22.

Consequently, the reflective condition of the reflective faces 52*a* and 52*b* is changed at excellent response timing based on which the ink end is detectable quickly and surely.

In the ink jet printer 91 with the ink tank 1 as an ink supply source according to this embodiment, the reflective condition of the reflective faces 52*a* and 52*b* provides the basis for making certain the detection of the ink end of the ink tank.

Figure 8:
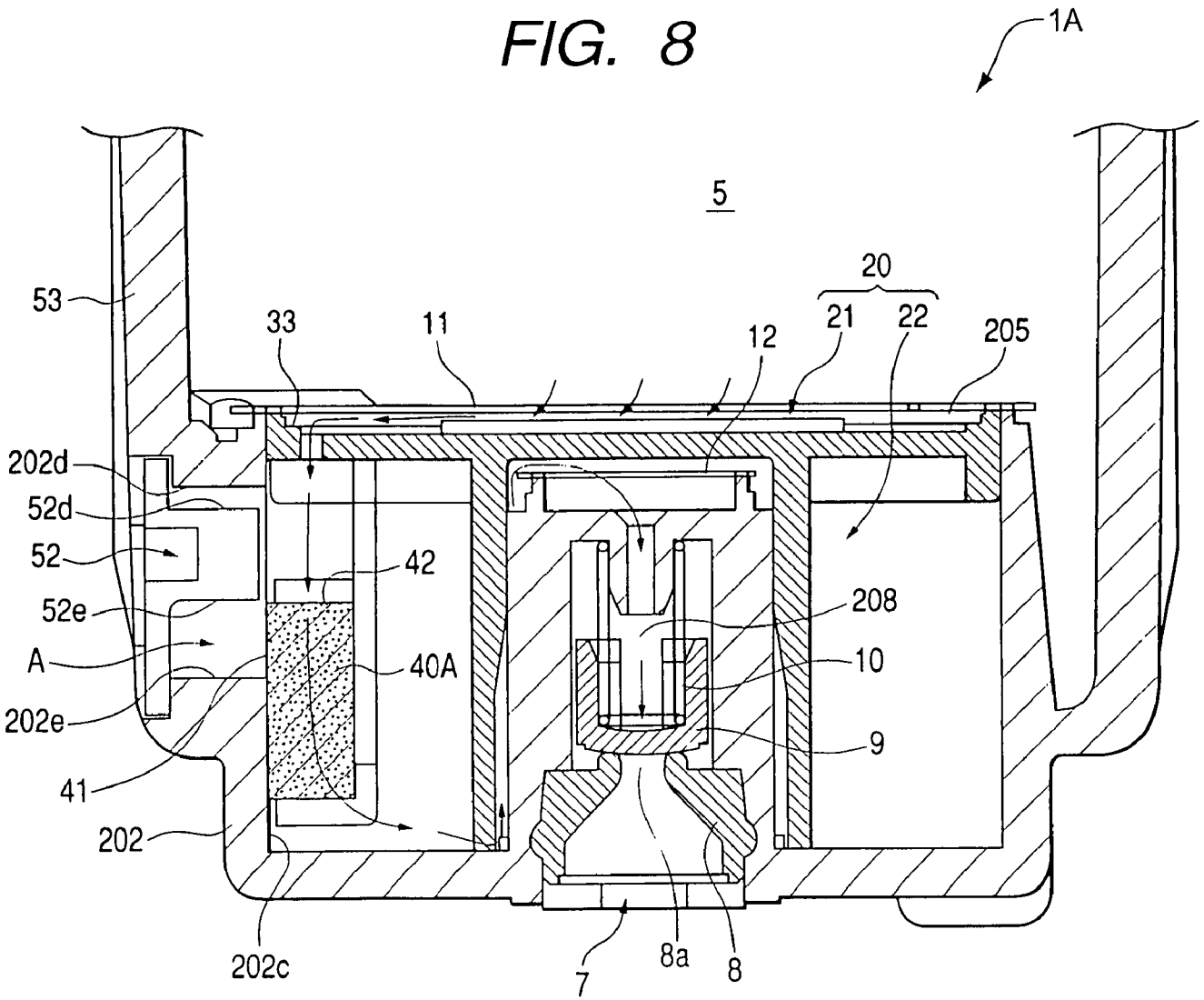
FIG. 8 is an enlarged sectional view of an essential part of an ink tank according to a second embodiment of the invention.
Figure 9A:
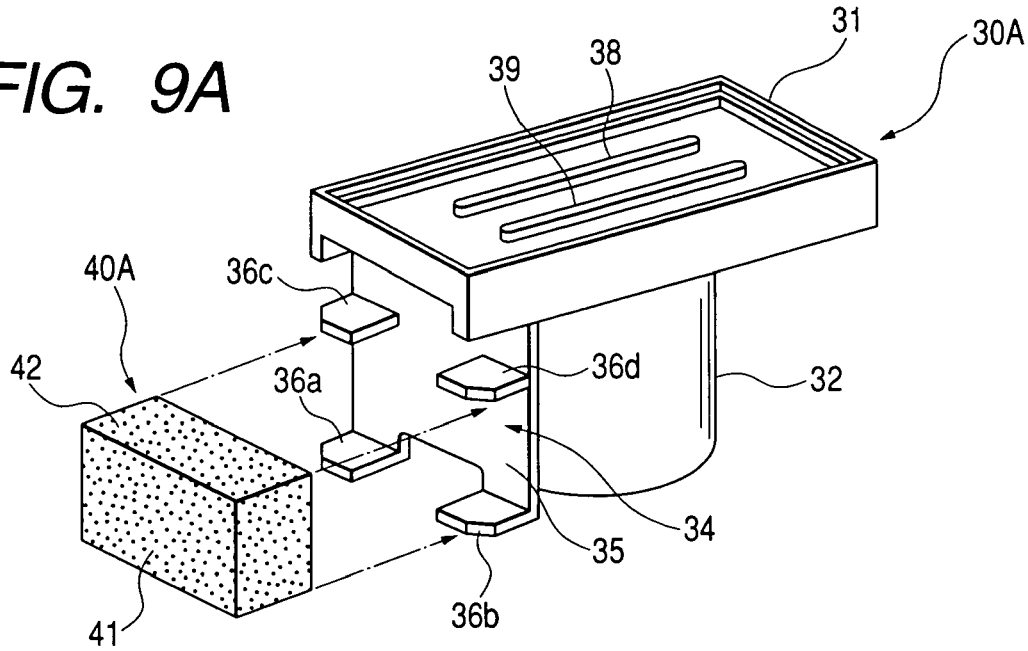
FIG. 9A is a perspective view of a partition member in the ink tank of the second embodiment.
Figure 9B:
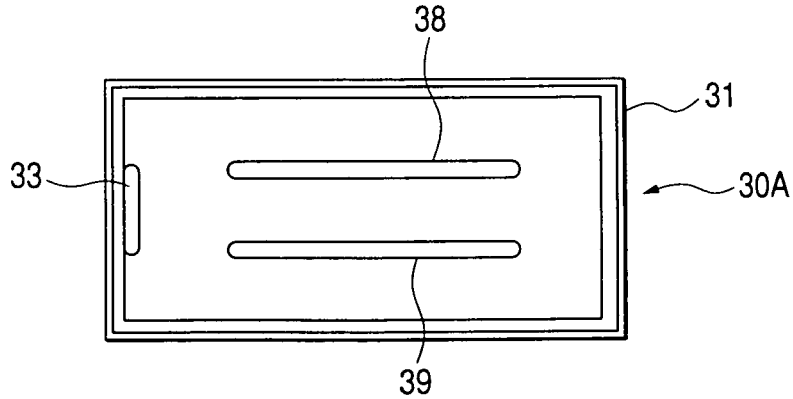
FIG. 9B is a top view of the partition member of FIG. 9A.
Figure 9C:
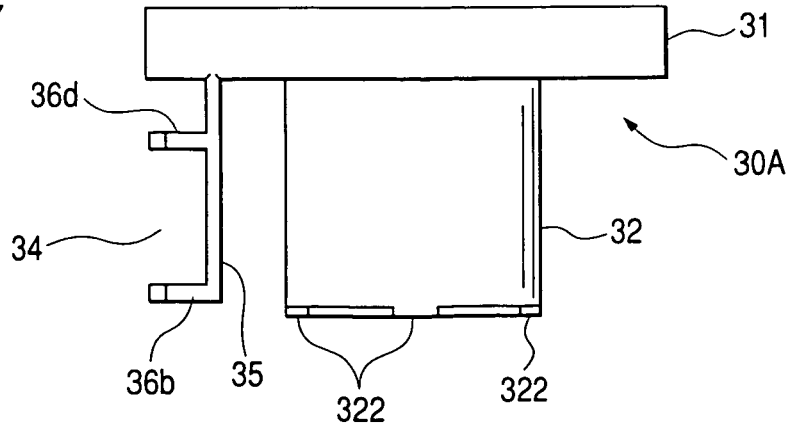
FIG. 9C is a front view of the partition member shown in FIG. 9A.

As shown in FIGS. 8 through 9C, an ink tank 1A according to a second embodiment of the invention is basically similar in structure to the ink tank 1 described above. As such, like corresponding parts are given like reference characters and the description thereof will be omitted. The ink tank 1A according to this embodiment is characterized in that a porous-member holder 34 for holding a bubble-extinguishing porous member 40A is provided in a partition member 30A. Moreover, the partition member 30A is used to form an ink passage through which ink introduced from the introduction hole 33 is led into the ink reservoir 22 flow via the back sides of the reflective faces 52*a* and 52*b* and the porous member 40A.

The partition member 30A of the ink tank 1A is provided with the partition panel 31, the cylindrical frame 32 projecting from the back surfaces of the ink reservoir 22 and the porous-member holder 34 in a side closer to the side of the right prism 52 than the cylindrical frame 32. The porous-member holder 34 is provided with a drop wall 35 having the same width as that of partition panel 31 and perpendicularly projecting from a bottom face of the partition panel 31 so that the lower end of the drop wall 35 is extended up to a position in the vicinity of the bottom of the ink reservoir 22. At the lower end of the drop wall 35, holding pieces 36*a* and 36*b* are perpendicularly projected from both the lateral end portions of the drop wall 35 toward the right prism 52. In the respective upper positions of these holding pieces, holding pieces 36*c* and 36*d* are also projected from the drop wall 35 toward the right prism 52. The holding ability for the porous member 40A is realized with the pair of upper holding pieces 36*c* and 36*d* and the pair of lower holding pieces 36*a* and 36*b*.

The porous member 40A is a rectangular parallelepiped having the same width as that of the drop wall 35 and is slightly greater in height than a vertical interval between the holding pieces so that the porous member 40A is stuffed between the holding pieces while being slightly compressed.

With the porous member 40A held between the holding pieces, the surface 41 of the porous member 40A on the side of the right prism 52 is kept in contact with the inner side face 202*c* of the frame 202. The upper end face 42 of the porous member 40A is positioned so that it is substantially the same in height as the lower end face 52*e* of the right prism 52. Therefore, the upper half portion of the surface 41 of the porous member 40A is in such a condition that it faces the space A adapted to surround the reflective faces 52*a* and 52*b* of the right prism 52.

Incidentally, the surface of the partition panel 31 of the partition member 30A is not an uneven surface but a flat one, and two ribs 38 and 39 for introducing ink toward the introduction hole 33 are formed on the surface.

Even in the ink tank 1A in this embodiment, the partition member 30A serves as a separator for promoting the separation of ink from bubbles.

Further, ink flowing from the introduction hole 33 into the ink reservoir 22 flows down between the drop wall 35 of the partition member 30A and the reflective faces 52*a* and 52*b*, and is absorbed by the porous member 40A. The ink is then directed to the second filter 12 via the partition member 30A. In other words, ink is made to flow along the ink passage regulated by the drop wall 35 as shown by arrows in FIG. 8.

The porous member 40A serves to quickly extinguish the bubbles introduced into the ink reservoir 22. More specifically, when the residual amount of ink decreases and when the consumption of the ink soaked into the porous member 40A of the ink reservoir 22 increases, bubbles enter the space A formed between the reflective faces 52*a* and 52*b* of the prism and the porous member 40A. The lower-side portion of the right prism 52 in the space A is in contact with the porous member 40A. When ink is taken out of the porous member 40A, the ink held in the bubbles gathered in the space A is sucked into the porous member 40A by the capillary force of the porous member 40A. Consequently, bubbles sticking to the back surfaces of the reflective faces 52*a* and 52*b* of the prism and those floating in the vicinity of the back surfaces are quickly extinguished by the porous member 40A.

With the ink tank 1A thus arranged, bubbles sticking to the back surfaces of the reflective faces 52*a* and 52*b* of the prism and those floating in the vicinity of the back thereof are quickly extinguished by the porous member 40A. Therefore, the ink end condition can immediately be detected without being obstructed by bubbles at a point of time the ink end condition is established.

Since the capacity of the partition panel 31 is small, the residual amount of ink in the porous member 40A can be decreased and the advantage is that the amount of ink to be wasted is reducible as well.

In the above embodiments, each of the partition members 30 and 30A is arranged so that the inside of the sub ink chamber 20 is partitioned into the bubble storage 21 and the ink reservoir 22. It is also adoptable to dispose the porous member in a position adjacent to the back surfaces of the reflective faces 52*a* and 52*b* with the omission of the partition members 30 and 30A. Even in this case, the bubbles generated in the portion on the back sides of the reflective faces are quickly extinguishable.

As the material of the porous members 40 and 40A, any material capable of absorbing and holding ink can be used. For example, porous material formed by intertwining natural or synthetic fibers or bundling fibers may be adopted. However, the use of felt and foam as the material is not particularly effective.

Although a smaller space A is needless to say better, it is further preferable to obviate the space A by bringing the upper end face 42 of the porous member 40A into contact with the lower end face 52*e* of the right prism 52.

Figure 10:
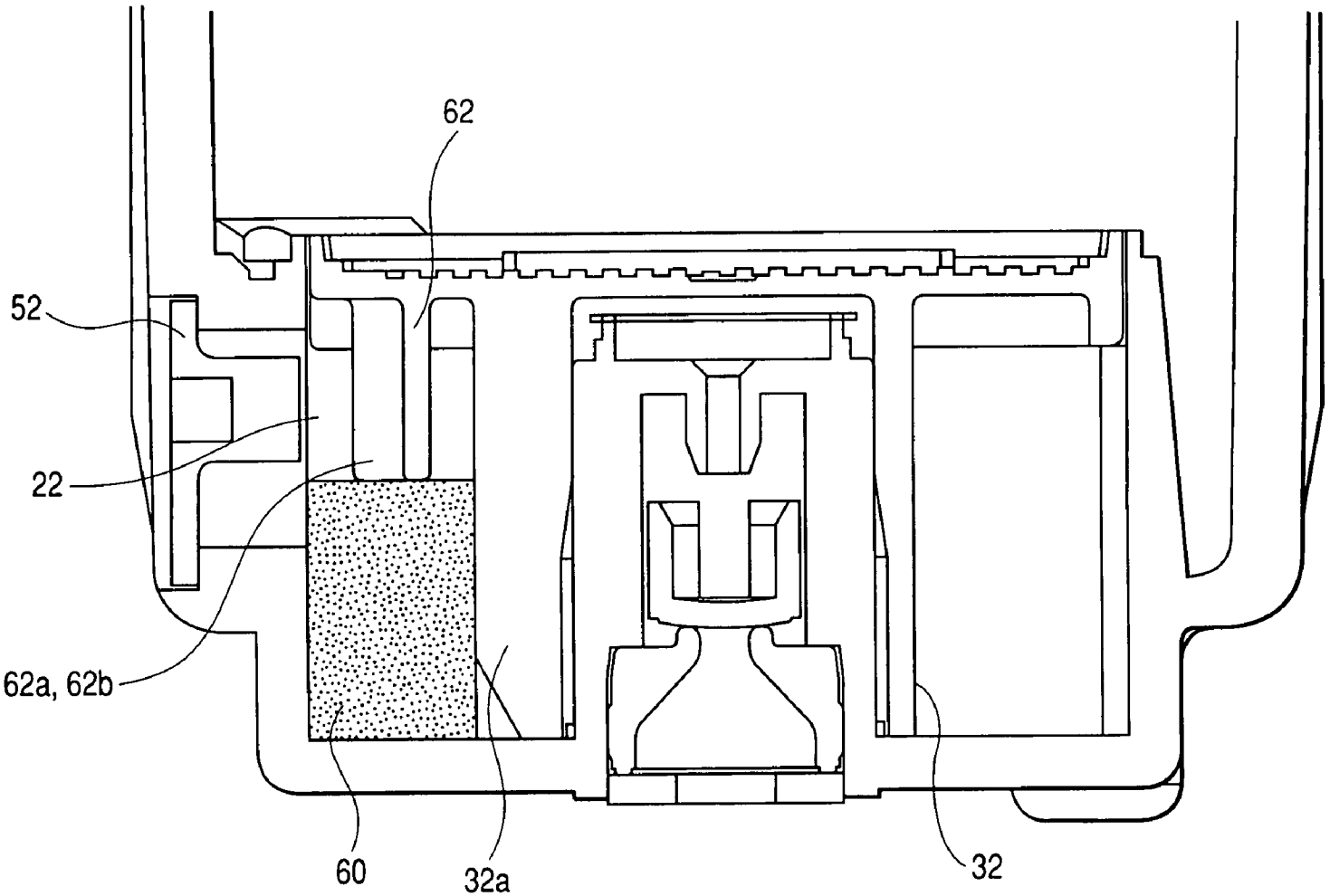
FIG. 10 is an enlarged sectional view of an essential part in an ink tank according to a third embodiment of the invention.
Figure 11:
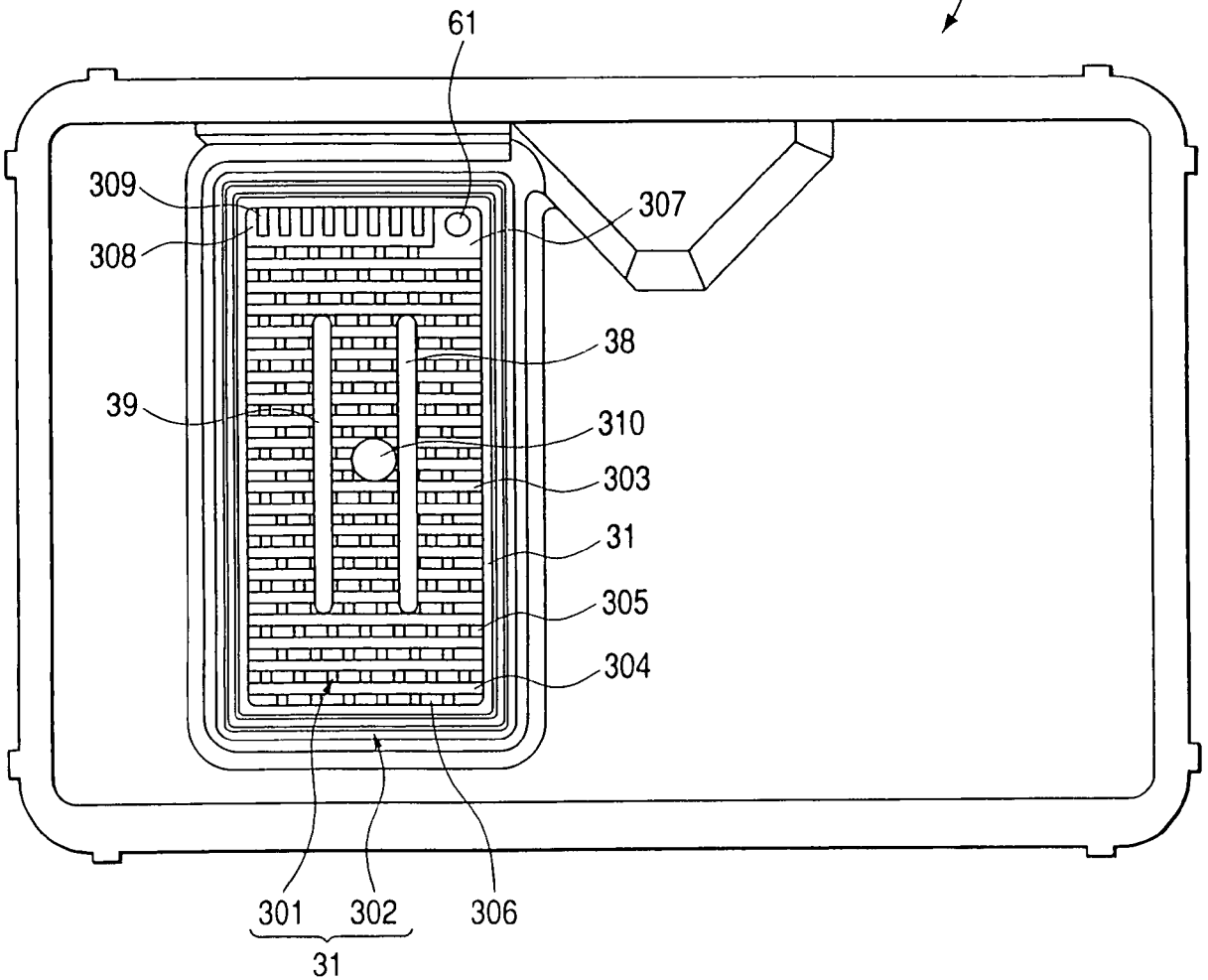
FIG. 11 is a transverse sectional view of the essential part in the ink tank of the third embodiment.
Figure 12:
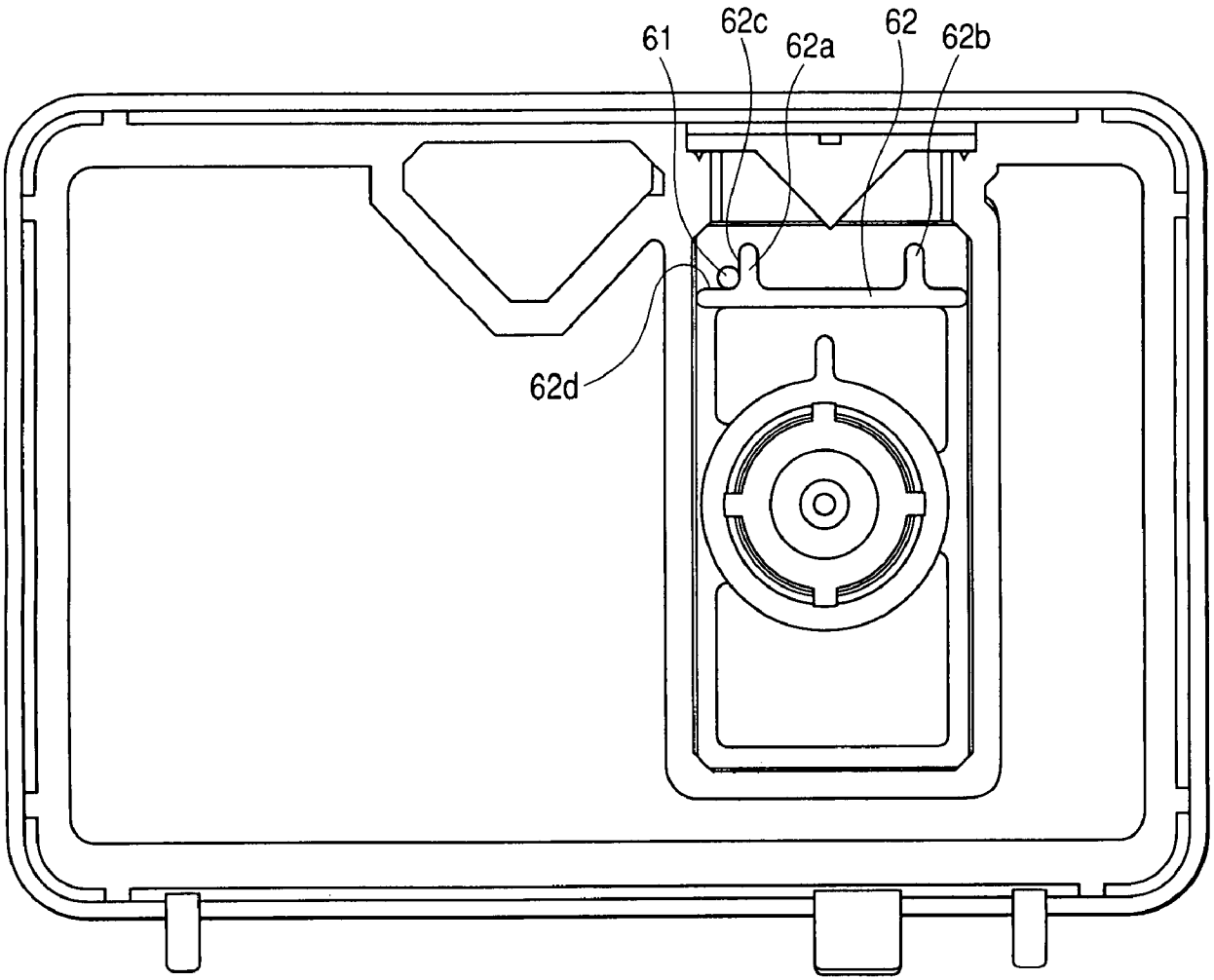
FIG. 12 is a transverse sectional view of the essential part in the ink tank of the third embodiment, viewed from the opposite side of FIG. 11.

FIGS. 10 through 12 show an ink tank 1B according to a third embodiment of the invention which is basically similar in structure to the ink tank 1 above. As such, like corresponding parts are given like reference characters and the description thereof will be omitted.

As shown in FIG. 11, the ink tank 1B in this embodiment is characterized in that a circular introduction hole 61 is formed at a corner of the panel body 301 in the side where the right prism 52 is disposed. The perimeter of the introduction hole 61 is surrounded with the protruded frame portion 307 equal in height to the protrusions 306. Moreover, the recessed portions 308 and the protruded portions 309 extending in the long side direction of the panel body 301 are alternately formed at predetermined intervals in the direction of the short side in a region between the protruded frame portion 307 and the long side edge of the panel body 301. The protruded portion 309 is equal in height to the protrusions 306.

As shown in FIGS. 10 and 12, a drop wall 62 and rib portions 62*a* and 62*b* projecting downward further than the central position in the vertical direction of the right prism 52 is formed on a bottom face of the panel body 301, the ribs 62*a* and 62*b* are directed from the drop wall 62 to the right prism 52. The rib portion 62*a* on one side and the drop wall 62 are formed so as to surround the introduction hole 61.

A porous member 60 is stuffed in between the inner side face 202*c* of the frame 202 fitted with the right prism 52 and a rib portion 32*a* protruded from the cylindrical frame 32 toward the right prism 52 such that the porous member 60 is kept in contact with the drop wall 62 and the lower ends of the rib portions 62*a* and 62*b*. The porous member 60 is placed in the position retracted down the direction of flow of ink with respect to the reflective faces 52*a* and 52*b* of the right prism 52.

With the ink tank 1B thus arranged, the ink caused to flow into the ink reservoir 22 from the introduction hole 61 flows downward between the drop wall 62 of the partition member 30B and the reflective faces 52*a* and 52*b*. The ink is then absorbed by the porous member 60, so that ink is directed to the second filter 12 via the porous member 60. In other words, ink flows along the ink passage regulated by the drop wall 62 and the rib 62*a*. In this case, it is preferable to provide not only the introduction hole 61 in a position separated from the reflective faces 52*a* and 52*b* but also a labyrinth wall so that floating bubbles existing between the introduction hole 61 and the reflective faces 52*a* and 52*b* are readily caught thereon.

With the arrangement above, the bubbles caused to flow from the introduction hole 61 into the ink reservoir 22 are caught on the corner portion between wall faces 62*c* and 62*d* of the drop wall 62 due to the surface tension generated thereon. Then the bubbles are moved downward along the wall faces 62*c* and 62*d* and absorbed by the porous member 60 which is in contact with the lower ends of the wall faces before being extinguished.

Consequently, with the ink tank 1B according to this embodiment, bubbles sticking to or floating around the back surfaces of the reflective faces 52*a* and 52*b* of the right prism 52 are quickly extinguished by the porous member 60 as in the second embodiment. Moreover, the bubbles caused to move from the introduction hole 61 are caught on the corner portion between the wall faces 62*c* and 62*d* so as to be guided to the porous member 60, whereby the floating bubbles can be decreased.

Therefore, the ink end condition can immediately be detected without being obstructed by bubbles at a point of time the ink end condition is established. As bubbles flowing out of the introduction hole 61 flow along the wall faces 62*c* and 62*d* after the detection of the ink end condition, the bubbles are prevented from sticking to the right prism 52 again, so that detection accuracy is improved as the presence of ink is never detected incorrectly.

The invention is not limited to the above-described embodiments but may be changed in various manners. Although a description has been given of a case where the ink chamber including the main ink chamber and the sub ink chamber that are separated from each other is employed by way of example, only an ink chamber corresponding to the sub ink chamber may be employed without using an ink chamber corresponding to the main ink chamber. Even in this case, the same effect is achievable because the bubbles thus generated are extinguished by the porous member in the position where they are subjected to the detection.

Although the reflection type detected portion has been described as the embodiments, a transmission type photosensor as described in Japanese Patent Publication No. 6-115089A may be employed. Even in this case, because bubbles in the position subjected to the detection are extinguishable, transmissivity is improved at the time ink has run out, which results in improving accuracy in detecting the presence or absence of ink, particularly black ink whose transmissivity is low.

Further, instead of the utilization of the wall faces provided on the partition panel body in the vicinity of the introduction hole, the inner wall of the main ink chamber may be used to define the ink flow passage.

What is claimed is:

1. An ink tank, comprising:

an ink chamber, formed with a vent port allowing atmospheric air to enter therein and an ink outlet from which ink is taken out;

an optical member, having an ink contact face capable of contacting with ink contained in the ink chamber, the ink contact face including a detection face for optically detecting an ink end state of the ink chamber in accordance with an amount of air entered into the ink chamber via the vent port; and an ink absorbing member, being in direct, partial and physical contact with a part of the ink contact face of the optical member.

2. The ink tank as set forth in claim 1, wherein the ink absorbing member is placed at an ink flow passage between the optical member and the ink outlet.

3. The ink tank as set forth in claim 1, wherein the ink absorbing member is disposed away from the detection face.

4. The ink tank as set forth in claim 1, wherein the ink absorbing member is comprised of at least one of a foam material and a felt material.

5. The ink tank as set forth in claim 1, wherein the optical member is a prism provided with a pair of reflective faces serving as the detection face.

6. The ink tank as set forth in claim 1, wherein the ink contact face is projected into the ink chamber, and the ink absorbing member is deformed by the ink contact face.

7. An ink jet printer, comprising:

an ink jet print head;

the ink tank as set forth in claim 1, which supplies ink to the ink jet print head via the ink outlet; and a detector, which detects the remaining amount of ink in the ink tank based on a condition of the detection face.

* * * * *